US010959557B1

(12) United States Patent
Nazarian

(10) Patent No.: US 10,959,557 B1
(45) Date of Patent: Mar. 30, 2021

(54) ERGONOMIC FOOD AND DRINK STORAGE TRAY

(71) Applicant: Henrik Nazarian, Montrose, CA (US)

(72) Inventor: Henrik Nazarian, Montrose, CA (US)

(73) Assignee: THUMBZ, INC., Montrose, CA (US)

( * ) Notice: Subject to any disclaimer, the term of this patent is extended or adjusted under 35 U.S.C. 154(b) by 0 days.

(21) Appl. No.: 16/864,467

(22) Filed: May 1, 2020

Related U.S. Application Data

(60) Provisional application No. 62/843,748, filed on May 6, 2019.

(51) Int. Cl.
*A47G 23/06* (2006.01)
*B65D 1/36* (2006.01)

(52) U.S. Cl.
CPC ..... *A47G 23/0641* (2013.01); *B65D 1/36* (2013.01)

(58) Field of Classification Search
CPC ..... A47G 23/0641; A47G 23/0625; A47G 23/0208; A47G 23/0608; A47G 23/02; B65D 1/36; B65D 1/34
USPC ..... 220/467, 575
See application file for complete search history.

(56) References Cited

U.S. PATENT DOCUMENTS

| | | | | |
|---|---|---|---|---|
| 1,953,933 | A | 4/1934 | Gundelach | |
| 2,826,346 | A | 3/1958 | Randall | |
| 3,381,825 | A | 5/1968 | Bessett | |
| 4,208,006 | A | 6/1980 | Bixle et al. | |
| 4,218,008 | A | 8/1980 | Veilleux | |
| 5,152,398 | A * | 10/1992 | Forestal | A47G 19/065 206/561 |
| 5,316,173 | A | 5/1994 | Emery | |
| 5,566,852 | A | 10/1996 | Emery | |
| 5,947,011 | A | 9/1999 | Xu | |
| 6,622,885 | B1 | 9/2003 | Erman | |
| 8,746,456 | B1 * | 6/2014 | Bradley | B65D 1/34 206/562 |
| 8,985,379 | B1 | 3/2015 | Evans | |
| 9,980,589 | B2 * | 5/2018 | Piccinini | A47G 23/0641 |
| 10,238,224 | B1 * | 3/2019 | Nazarian | A47G 23/0625 |
| 2009/0211937 | A1 | 8/2009 | Sharma et al. | |
| 2010/0108560 | A1 * | 5/2010 | Macarthur-Onslow | A47G 19/065 206/561 |
| 2011/0259785 | A1 | 10/2011 | Veenje et al. | |
| 2011/0278187 | A1 | 11/2011 | Yang et al. | |
| 2014/0231438 | A1 | 8/2014 | Linneken | |
| 2015/0230643 | A1 * | 8/2015 | Kamei | A47G 23/0625 206/139 |

* cited by examiner

*Primary Examiner* — J. Gregory Pickett
*Assistant Examiner* — Jenine Pagan
(74) *Attorney, Agent, or Firm* — Plager Schack LLP; Mark H. Plager; Eric Liou

(57) ABSTRACT

An ergonomic storage tray with enhanced stability to secure beverage storing cups and food items is provided. The storage tray includes a tray having a top surface, a bottom surface, a first pair of opposing side surfaces, a second pair of opposing side surfaces, and a plurality of compartments designed to store beverage storing cups and food items. The tray includes an off-center thumb hole and a cutout on a side surface in the first pair of opposing side surfaces. The thumb hole in the tray receives the thumb of the user, the cutout in the tray receives the upper arm and elbow of the user, and the bottom surface of the tray contacts the forearm of the user, thereby securely supporting the beverage storing cups and food items in the tray.

15 Claims, 5 Drawing Sheets

ERGONOMIC FOOD AND DRINK STORAGE TRAY

RELATED APPLICATION

The application claims priority to provisional patent application U.S. Ser. No. 62/843,748 filed on May 6, 2019, the entire contents of which is herein incorporated by reference.

BACKGROUND

The embodiments herein relate generally to cup and food holding trays and devices.

During sporting events, concerts and other entertainment shows, spectators have to carry and juggle one or more beverage storing cups and/or food items from the concessions to the seating area. This often involves carrying and balancing these food and drink items up or down stairs and around other spectators in a row before reaching a designated seat. This is difficult to accomplish as the beverage storing cups and/or food items can easily tilt or slip out of the individual's hands, thereby spilling and/or dropping the items on other spectators or the floor.

In some circumstances, a concession will provide trays to store these beverages and food items. However, these trays do not provide proper designated hand holding areas to improve the balance and weight distribution of the carrier and any cups or food items stored thereon. This makes it difficult to maneuver the carrier and results in the increased frequency of spillage of beverages and/or food items due to a tilted tray. These accidents create burdens on individuals to clean up beverages or food stains on their clothing, and venue staff to clean spills on the seats or floor at the venue.

Several plates and trays for supporting cups, glasses or food items are disclosed in U.S. Patent Application Publication 2014/0231438, and U.S. Pat. Nos. 10,238,224, 6,622,885 and 5,947,011. However, these plates and trays are limited in that they do not provide the support, stability, ease-of-use and/or ergonomics to enable a user to effectively balance and transport a plurality of beverage storing cups and food items through crowded and closed quarters at a stadium or other venue.

As such, there is a need in the industry for an ergonomic food and drink storage tray that addresses the limitations of the prior art, which effectively allows a user to maneuver and balance the tray and any beverage storing cups or food items placed thereon. There is a need for the storage tray to be designed for use at crowded venues during sporting events, concerts or other entertainment shows.

SUMMARY

In certain embodiments of the invention, an ergonomic storage tray with enhanced stability for use to secure a plurality of beverage storing cups and food items is provided. The storage tray is configured to be supported by a thumb, fingers, upper arm, elbow and forearm of a user. The storage tray comprises a tray comprising a top surface, a bottom surface opposite the top surface, a first pair of opposing side surfaces connecting the top and bottom surfaces together, and a second pair of opposing side surfaces connecting the top and bottom surfaces together, the tray comprising a plurality of compartments configured to store any number of the beverage storing cups and food items, the tray comprising an off-center thumb hole disposed therethrough and located proximate a first side surface in the first pair of opposing side surfaces, and a cutout disposed entirely through the top and bottom surfaces of the tray and located on a second side surface in the first pair of opposing side surfaces, wherein the thumb hole in the tray is configured to receive the thumb of the user, the cutout in the tray is configured to receive the upper arm and elbow of the user therein, and the bottom surface of the tray is configured to contact the forearm of the user, thereby securely supporting any number of the beverage storing cups and food items in the tray.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
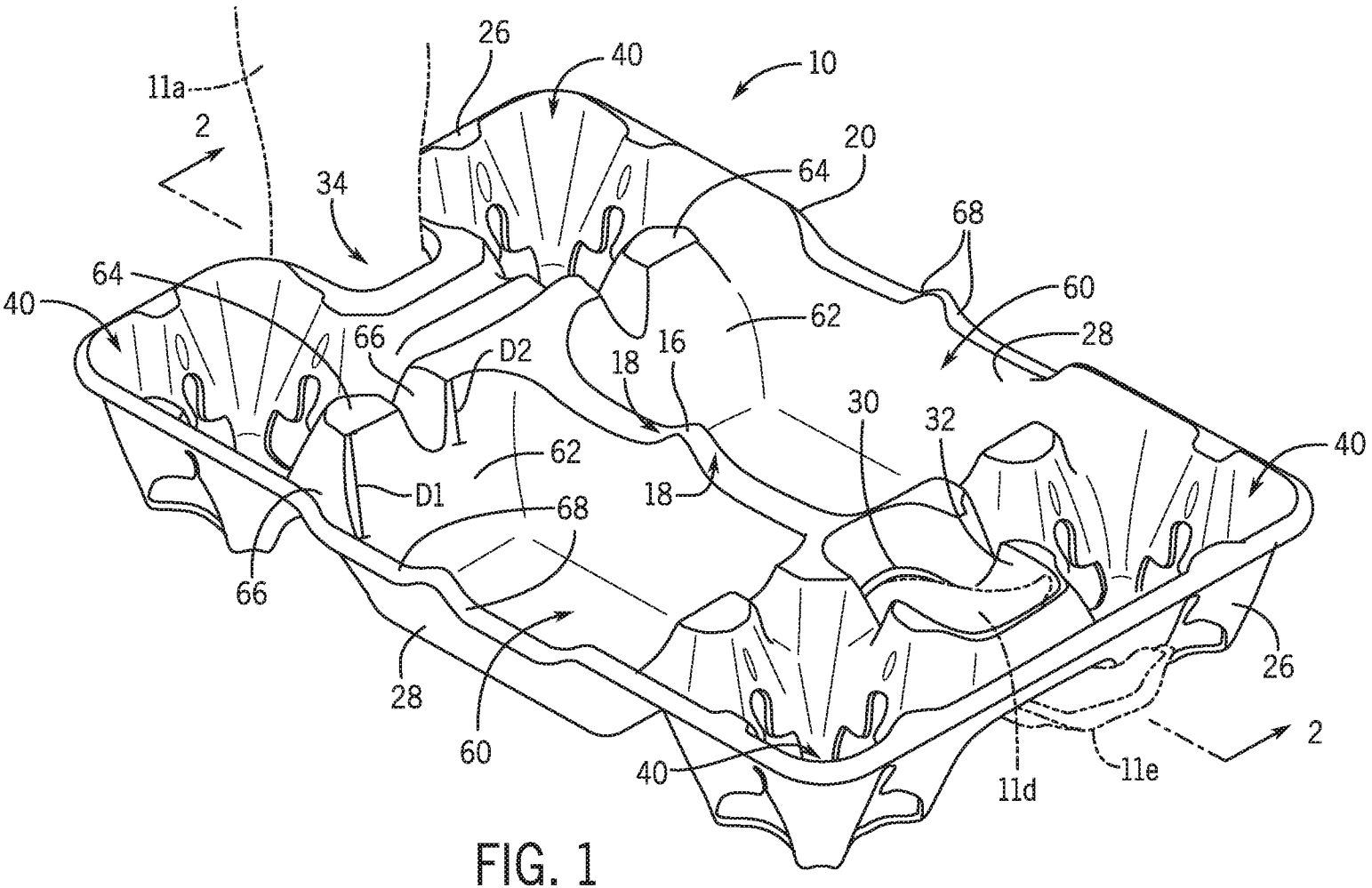
FIG. 1 depicts a perspective view of certain embodiments of the storage tray shown in use.
Figure 2:
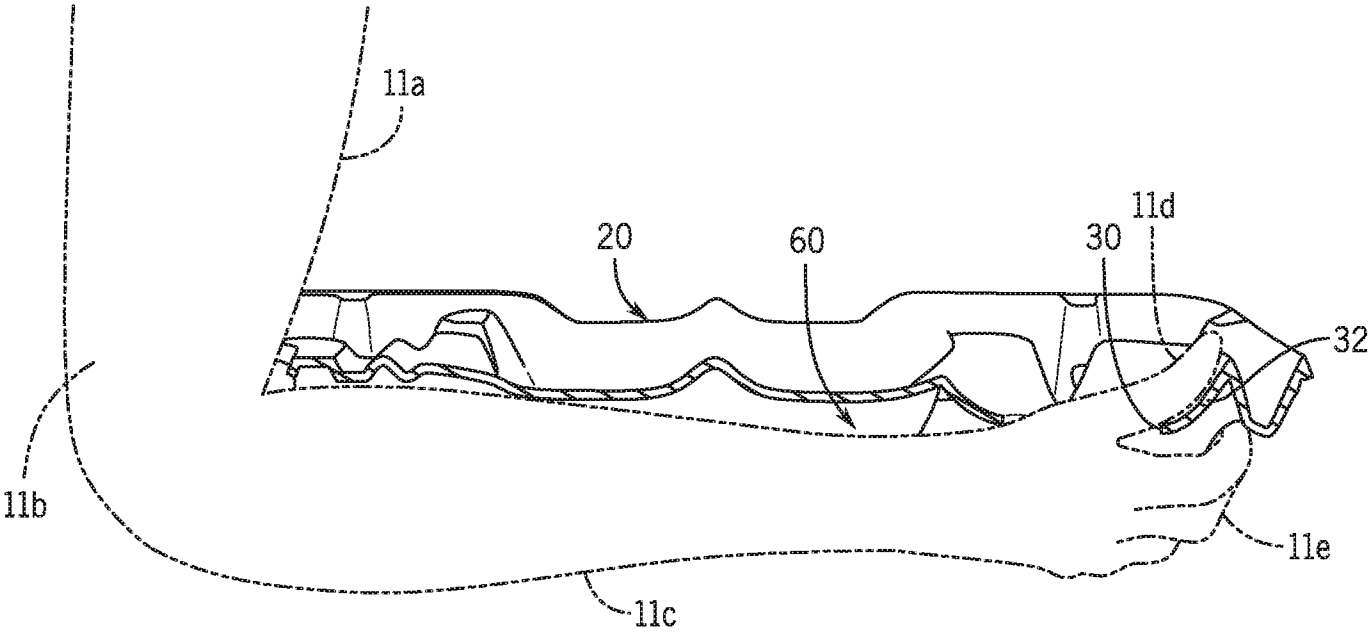
FIG. 2 depicts a cross-sectional view of certain embodiments of the storage tray taken along line 2-2 in FIG. 1.

In certain embodiments of the invention as depicted in FIGS. 1-4, storage tray 10 is configured for use by a user to store a plurality of beverage storing cups and food items. As depicted in FIGS. 1-2, storage tray 10 is configured to be in contact with and supported by upper arm 11*a*, elbow 11*b*, forearm 11*c*, thumb 11*d* and fingers 11*e* of the user. This allows the user to secure, maneuver and balance the plurality of beverage storing cups and food items on storage tray 10 with enhanced stability. Storage tray 10 is beneficial for use in locations such as stadiums, movie theaters, food courts, sporting events, concerts, county fairs, and other public events or locations.

Figure 3:
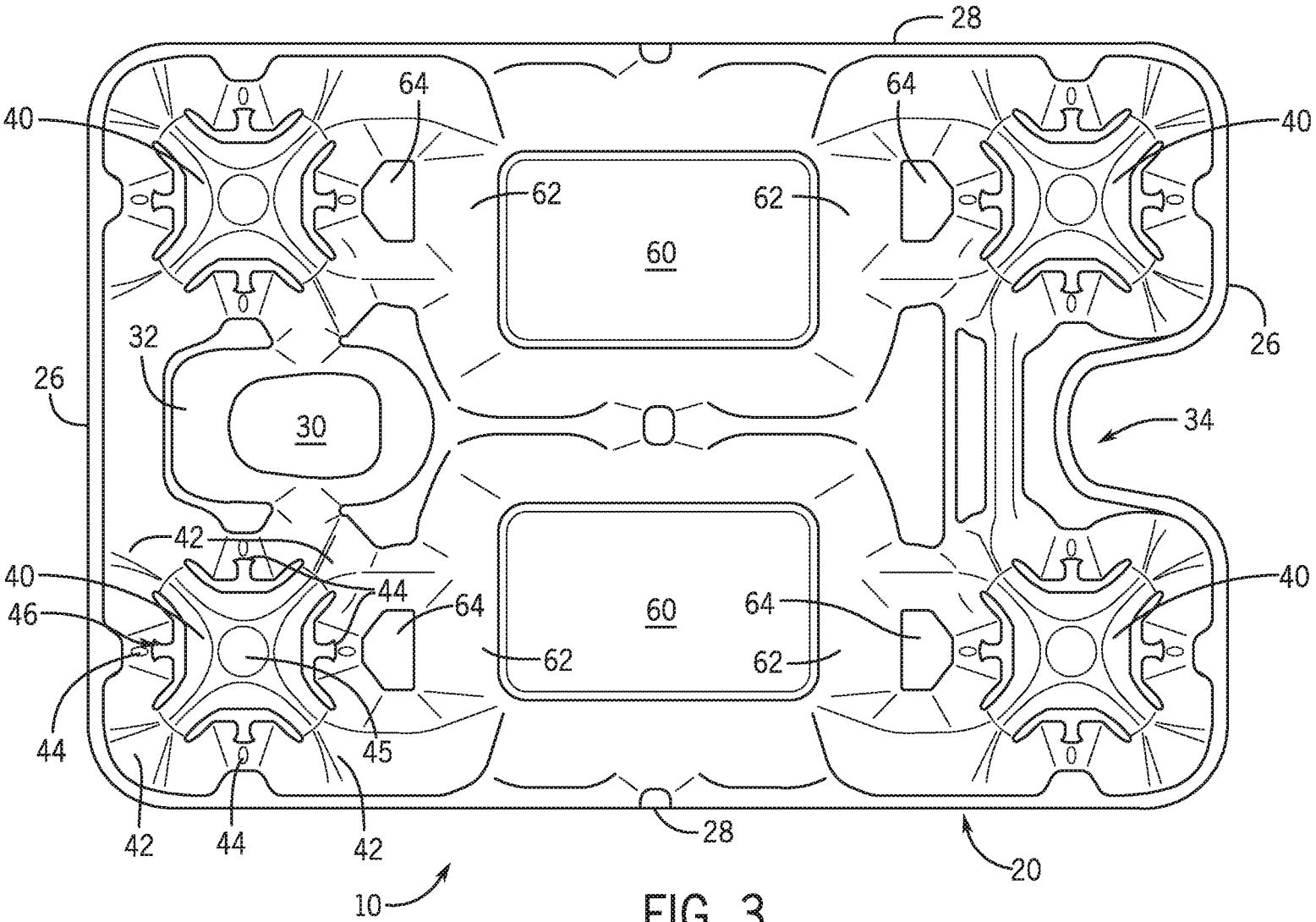
FIG. 3 depicts a top view of certain embodiments of the storage tray.
Figure 4:
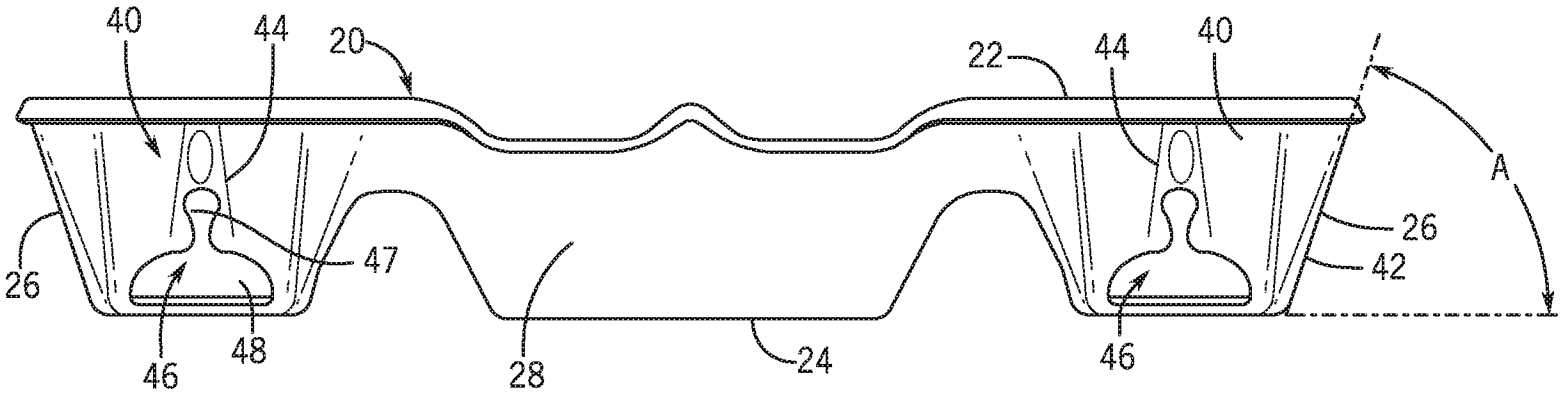
FIG. 4 depicts a side view of certain embodiments of the storage tray.

In one embodiment as depicted in FIGS. 1 and 3-4, storage tray 10 comprises tray 20 comprising top surface 22, bottom surface 24, a first pair of opposing side surfaces 26 and a second pair of opposing side surfaces 28. In certain embodiments, tray 20 comprises a first set of compartments illustrated by corner compartments 40 configured to store beverage storing cups and a second set of compartments illustrated by intermediate compartments 60 configured to store food items, condiments, utensils or other items.

In one embodiment, tray 20 comprises approximate dimensions of a 16" length, 11" width, and 2½" height. However, the dimensions and shape of tray 20 can vary in alternative embodiments to accommodate all users including adults and children. In one embodiment, the corners of tray 20 are rounded. Tray 20 is made from pressed paper, but can be made from any material or combination of materials known in the field.

In one embodiment, storage tray 10 comprises thumb hole 30 located off-center on tray 20 and located proximate a first side surface in the first pair of opposing side surfaces 26. In one embodiment as depicted in FIGS. 1-3, thumb hole 30 comprises an oval-shape with sloped side wall 32, which is configured to conform to contours of thumb 11*d* of the user. In one embodiment, thumb hole 30 comprises approximate dimensions of a top front portion width of 1¼", top rear portion width of 1½", a length of 2.125", and a depth of 1". However, it shall be appreciated that the size, dimensions and shape of thumb hole 30 can vary in alternative embodiments to accommodate different users.

In one embodiment as depicted in FIGS. 1 and 3, storage tray 10 comprises cutout 34 disposed entirely through top and bottom surfaces 22, 24 and located on a second side surface in the first pair of opposing side surfaces 26 on tray 20. Cutout 34 is preferably aligned with thumb hole 30 on tray 20 and is configured to receive upper arm 11*a* and/or elbow 11*b* as depicted in FIGS. 1-2.

In one embodiment as depicted in FIGS. 1 and 3, storage tray 10 comprises four corner compartments 40. Each corner compartment 40 is formed by an alternating and continuous pattern of corner side walls 42 and flexible side walls 44. In one embodiment, each corner compartment 40 comprises a generally square shape with rounded corners at top surface 22 of tray 20. In one embodiment, corner compartment 40 comprises dimensions of approximately 3¼×3V at top surface 22, a height of approximately 2½", and a separation distance of approximately 4½" between opposing rounded corners on top surface 22 of tray 20.

Corner side walls 42 are continuously connected to bottom platform 45. In one embodiment, corner side wall 42 is approximately 1" wide at top surface 22 of tray 20, and gradually tapers to approximately ½" wide at bottom surface 24 of tray 20 at the connection with bottom platform 45. The generally rigid nature of corner side walls 42 provides structural support and strength to corner compartment 40 to sufficiently support a beverage storing cup therein. In one embodiment as depicted in FIG. 4, each corner side wall 42 is oriented an angle A relative to a horizontal plane, wherein A is equal to approximately 70 degrees.

In one embodiment as depicted in FIGS. 3-4, each flexible side wall 44 comprises opening 46 having upper portion 47 continuously connected to lower portion 48. In one embodiment, lower portion 48 of opening 46 comprises a first area that is greater than a second area of upper portion 47 of opening 46. In one embodiment, lower portion 48 of opening 46 comprises a semi-circular shape. In one embodiment, upper portion 47 of opening 46 comprises a circular or oval shape. Opening 46 allows each flexible side wall 44 to bend and securely grip different-sized beverage storing cups therein.

It shall be appreciated that the size and shape of corner compartments 40 can vary in alternative embodiments to accommodate beverage storing cups having different sizes and shapes.

In one embodiment as depicted in FIGS. 1 and 3, storage tray 10 comprises a pair of intermediate compartments 60 located in a central portion of tray 20 and separated from each other by dividing wall 16. In one embodiment, intermediate compartment 60 comprises approximate dimensions of 7"×5" at the top, approximate dimensions of 5"×3" at the bottom, and a height of approximately 2½". However, the shape and dimensions of intermediate compartments 60 can vary in alternative embodiments. In one embodiment, the bottom of intermediate compartment 60 is elevated approximately ½" above the lowest point of tray 20 to permit multiple storage trays 10 to be stacked on top of each other.

In one embodiment, each intermediate compartment 60 comprises a generally rectangular shape with rounded corners formed by dividing wall 16, a pair of opposing interior walls 62 and one of the side surfaces in the second pair of opposing side surfaces 28. The pair of opposing interior walls 62 separates intermediate compartment 60 from an adjacent pair of corner compartments 40.

In one embodiment as depicted in FIGS. 1 and 3, each interior wall 62 comprises peak 64 and first pair of depressions 66 on top surface 22 of tray 20. In one embodiment, first pair of depressions 66 is located on opposing sides of peak 64. The depressions in first pair of depressions 66 extend from top surface 22 of tray 20 a distance of Di and Da respectively toward bottom surface 24 of tray 20. In one embodiment, Di is greater than Dz. Peaks 64 and first pairs of depressions 66 in tray 20 enhance the stability of storage tray 10, particularly when under load and supporting beverage storing cups and/or food items.

In one embodiment as depicted in FIGS. 1 and 3, dividing wall 16 comprises second pair of depressions 18 on top surface 22 of tray 20. Similarly, each side surface in second pair of opposing side surfaces 28 comprises third pair of depressions 68. Second pair of depressions 18 in dividing wall 16 and third pair of depressions 68 in second pair of opposing side surfaces 28 are aligned with each other. These depressions 18, 68 help to secure multiple storage trays 10 together when stacked. Further, depressions 18, 68 are aligned together to support larger food items such as hot dogs and buns thereon, which are too large to place within intermediate compartments 60. In one embodiment, each depression in second and third pairs of depressions 18, 68 comprises a width of approximately 3" and depth of approximately ½". However, the size of these depressions can vary in alternative embodiments.

In operation, storage tray 10 is loaded with any number of food items and/or beverages. Food items such as hot dogs, hamburgers, other sandwiches, French fries, popcorn, nachos, condiments or other items are disposed in either or both intermediate compartments 60 in tray 20. In one embodiment, one or more beverage storing cups are inserted within corner compartments 40. Each beverage storing cup is securely fastened to corner side walls 42, flexible side walls 44 and bottom platform 45 of corner compartment 40. In certain embodiments, each beverage storing cup can be any container designed to store liquids such as bottles, cups, cans, and the like.

The user carries storage tray 10 to transport the stored food items and/or beverages. In one embodiment as depicted in FIGS. 1-2, the user inserts portions of upper arm 11*a* and/or elbow 11*b* into cutout 34 in tray 20 and thumb 11*d* in thumb hole 30 from the bottom of tray 20. This allows forearm 11*c* of the user to contact bottom surface 24 of tray 20 to support storage tray 10. With upper arm 11*a* and/or elbow 11*b* nested within cutout 34, forearm 11*c* in contact with tray 20 and thumb 11*d* pressed against sloped sidewall 32 of thumb hole 30 in tray 20, the user can securely support and maneuver storage tray 10 and any food items and beverages secured thereon. For additional support, remaining fingers 11*e* of the user can wrap around the bottom of corner compartment 40.

The use of storage tray 10 to store food items and/or beverages has numerous advantages. Storage tray 10 provides the user a comfortable and stable platform that can be carried and balanced using one arm. This frees the user's other arm to perform a variety of functions such as holding a cell phone or support objects such as railings on staircases, grabbing keys or other objects, opening doors, holding a child's hand, etc. The position of forearm 11*c* of the user along the center of bottom surface 24 of tray 20 creates an even weight balance of storage tray 10 on both sides of forearm 11*c*. This enhances user comfort and stability, while minimizing the likelihood tray 20 inadvertently tips and spills the beverage storing cup(s) and/or food item(s).

Figure 5:
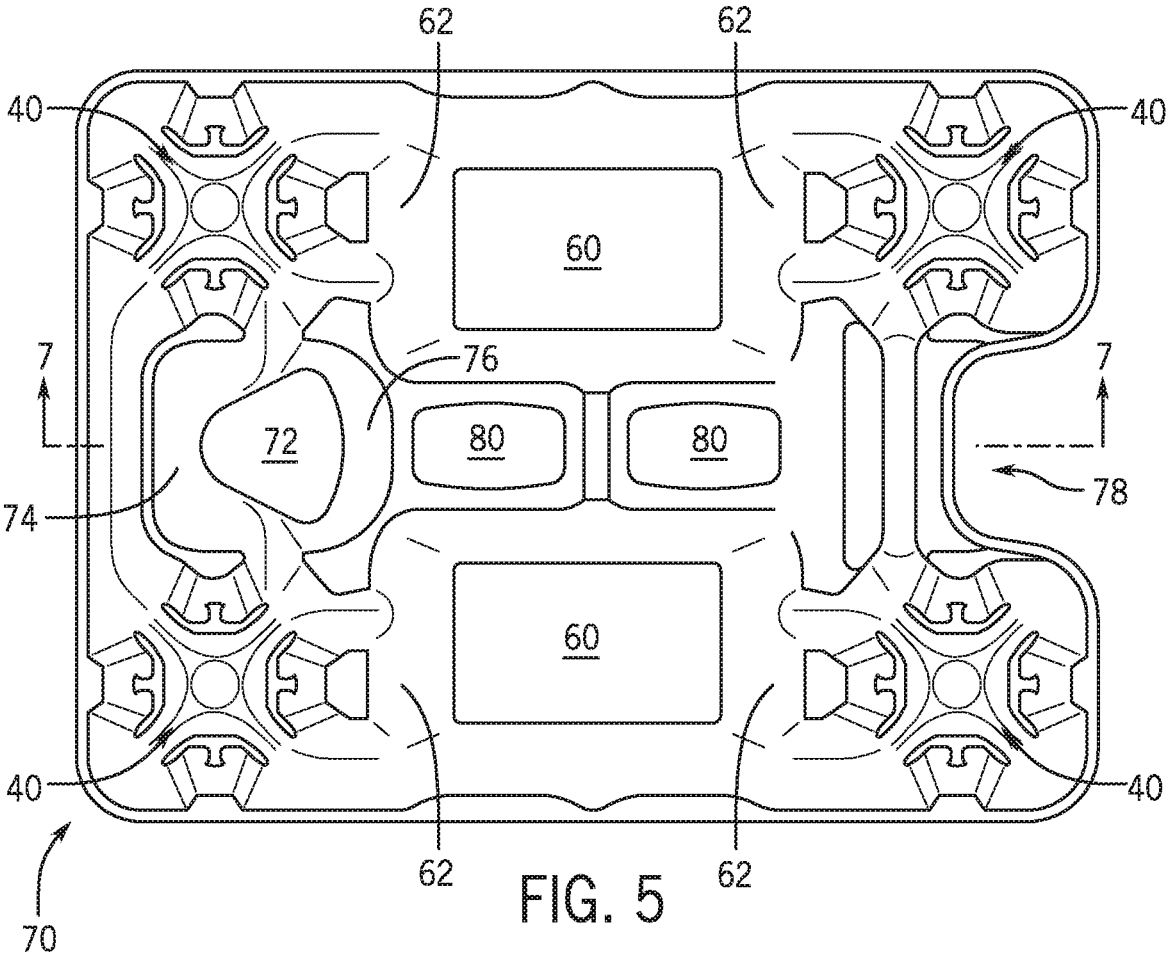
FIG. 5 depicts a top view of an alternative embodiment of the storage tray.
Figure 6:
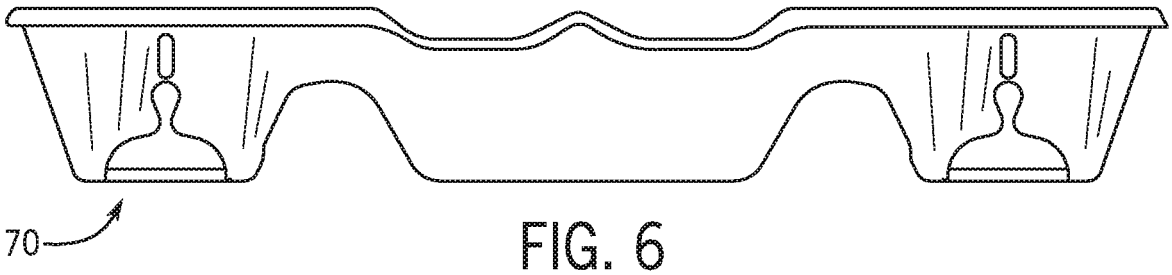
FIG. 6 depicts a side view of the alternative embodiment of the storage tray.
Figure 7:
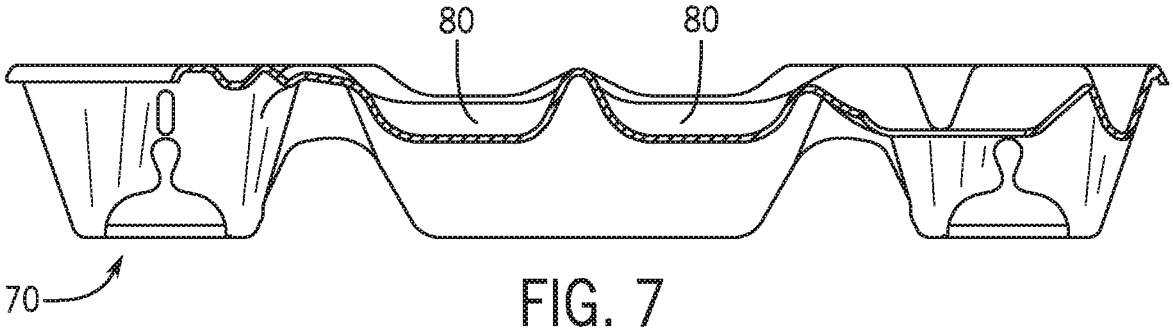
FIG. 7 depicts a cross-sectional view of the alternative embodiment of the storage tray taken along line 7-7 in FIG. 5.

It shall be appreciated that the storage tray can have a variety of design modifications to accommodate different users including children and adults having different sized hands, fingers, forearms, etc. In an alternative embodiment as depicted in FIGS. 5-7, alternate storage tray 70 is illustrated, which comprises the same components as storage tray 10 previously described such as corner compartments 40, intermediate compartments 60 and interior walls 62. In one embodiment, alternate storage tray 70 comprises approximate dimensions of a 16" length, 12" width, and 2½" height.

In one embodiment as depicted in FIG. 5, alternate storage tray 70 comprises alternate thumb hole 72, which comprises a triangular shape formed by front end side wall 74 continuously connected to rear end side wall 76. The triangular shape of alternate thumb hole 72 is advantageous for use by children or other individuals having shorter forearms.

In previous embodiments as depicted in FIGS. 1-2, the user depresses thumb 11*d* onto the front end portion of sloped sidewall 32 in thumb hole 30 to grip storage tray 10. In contrast as depicted in FIG. 5, a user with a shorter forearm can grip alternate thumb hole 72 in alternate storage tray 70 by extending fingers 11*e* through alternate thumb hole 72 and back onto rear end side wall 76 of the thumb hole. As such, one or multiple fingers 11*e* of the user can be used to securely grip alternate storage tray 70 via alternate thumb hole 72.

In one embodiment as depicted in FIG. 5, alternate storage tray 70 comprises alternate cutout 78, which is wider than cutout 34 in storage tray 10. The increase in width of alternate cutout 78 allows alternate storage tray 70 to accommodate users having wider upper arms 11*a* and/or elbows 11*b*. In one embodiment, alternate cutout 78 of alternate storage tray 70 is 3" wide. However, the size and shape of the cutout can vary in alternative embodiments.

In one embodiment as depicted in FIGS. 5 and 7, alternate storage tray 70 comprises a pair of condiment compartments 80 in the center of the tray. Condiment compartments 80 are configured to store any condiments, spices or other items. It shall be appreciated that the size, number and location of condiment compartments 80 and intermediate compartments 60 can vary in alternative embodiments.

It shall be appreciated that the components of the storage tray described in several embodiments herein may comprise any alternative known materials in the field and be of any color, size and/or dimensions. It shall be appreciated that the components of the storage tray described herein may be manufactured and assembled using any known techniques in the field. Although the figures illustrate four corner compartments 40 and two intermediate compartments 60 on storage tray 10, it shall be appreciated that the number and location of these compartments on storage tray 10 can vary in alternative embodiments.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. An ergonomic storage tray with enhanced stability for use to secure a plurality of beverage storing cups and food items, the storage tray configured to be supported by a thumb, fingers, upper arm, elbow and forearm of a user, the storage tray comprising:

a tray comprising a top surface, a bottom surface opposite the top surface, a first pair of opposing side surfaces connecting the top and bottom surfaces together, and a second pair of opposing side surfaces connecting the top and bottom surfaces together, the tray comprising a plurality of compartments configured to store any number of the beverage storing cups and food items; the tray comprising an off-center thumb hole disposed therethrough and located proximate a first side surface in the first pair of opposing side surfaces, and a cutout disposed entirely through the top and bottom surfaces of the tray and located on a second side surface in the first pair of opposing side surfaces, wherein the cutout is aligned with the thumb hole along a central length of the tray, said central length extending from said first side surface to said second side surface, wherein the plurality of compartments are positioned symmetrically about said central length;

wherein the thumb hole in the tray is configured to receive the thumb of the user, the cutout in the tray is configured to receive the upper arm and/or elbow of the user therein, and the bottom surface of the tray is configured to contact the forearm of the user, thereby securely supporting any number of the beverage storing cups and food items in the tray.

2. The storage tray of claim 1, wherein the thumb hole in the tray comprises an oval shape having a sloped sidewall immediately adjacent said thumb hole, said sloped sidewall configured to conform to contours of the thumb of the user.

3. The storage tray of claim 1, wherein the plurality of compartments comprises a first pair of cup compartments, each configured to store a beverage storing cup of the plurality of beverage storing cups; a second pair of cup compartments, each configured to store a beverage storing cup of the plurality of beverage storing cups; and a pair of food storage compartments configured to store the food items, wherein said first pair of cup compartments are disposed on opposite sides of said central length proximate said first side surface, said second pair of cup compartments are disposed on opposite sides of said central length proximate said second side surface, and said pair of food storage compartments are disposed on opposite sides of said central length between said first pair of cup compartments and said second pair of cup compartments.

4. The storage tray of claim 3, wherein the thumb hole is positioned substantially between said first pair of cup compartments, and said cutout is positioned substantially between said second pair of cup compartments.

5. The storage tray of claim 4, wherein each cup compartments is located on a corner of the tray and is formed by an alternating series of one of a plurality of corner side walls continuously connected to one of a plurality of flexible side walls, the plurality of corner side walls in the compartment directly coupled to a bottom platform.

6. The storage tray of claim 5, wherein each flexible side wall in the plurality of flexible side walls in the compartment comprises an opening disposed therethrough, the opening comprising an upper portion having a first area continuously connected to a lower portion having a second area, wherein the second area of the lower portion of the opening is greater than the first area of the upper portion of the opening.

7. The storage tray of claim 6, wherein each corner side wall in each cup compartment is oriented approximately 70 degrees relative to a horizontal plane.

8. The storage tray of claim 6, wherein the pair of food storage compartments are separated by a dividing wall, each food storage compartment in the pair of food storage compartments separated from the first and second pairs of cup compartments by a pair of interior walls.

9. The storage tray of claim 8, wherein each interior wall in the pair of interior walls comprises a peak at the top surface of the tray and a first pair of depressions positioned on opposing sides of the peak.

10. The storage tray of claim 9, wherein a first depression in the first pair of depressions extends a first distance toward the bottom surface of the tray and the second depression in the first pair of depressions extends a second distance toward the bottom surface of the tray, wherein the first distance is greater than the second distance.

11. The storage tray of claim 10, wherein the dividing wall comprising a second pair of depressions on the top surface of the tray.

12. The storage tray of claim 11, wherein each food storage compartment in the pair of food storage compartments comprises a third pair of depressions on the top surface of the tray and one of the second pair of opposing side surfaces.

13. The storage tray of claim 12, wherein the second pair of depressions on the dividing wall is aligned with the third pair of depressions on the intermediate compartment.

14. The food storage tray of claim 4, wherein the storage tray is configured to enable a user's fingers to wrap around a bottom of one of said first pair of cup compartments, while the user's thumb extends through said thumb hole.

15. The food storage tray of claim 4, wherein the thumb hole in the tray has a sloped sidewall immediately adjacent said thumb hole, said sloped sidewall configured to conform to contours of the thumb of the user.

* * * * *